US007229366B2

(12) United States Patent
Hollrock

(10) Patent No.: US 7,229,366 B2
(45) Date of Patent: Jun. 12, 2007

(54) BATTING SYSTEM

(76) Inventor: J. Richard Hollrock, 2 Valley View, South Deerfield, MA (US) 01373

( * ) Notice: Subject to any disclaimer, the term of this patent is extended or adjusted under 35 U.S.C. 154(b) by 0 days.

(21) Appl. No.: 10/501,368

(22) PCT Filed: Jan. 14, 2003

(86) PCT No.: PCT/US03/00983

§ 371 (c)(1),
(2), (4) Date: Mar. 30, 2005

(87) PCT Pub. No.: WO03/059467

PCT Pub. Date: Jul. 24, 2003

(65) Prior Publication Data

US 2005/0170915 A1 Aug. 4, 2005

Related U.S. Application Data

(60) Provisional application No. 60/350,299, filed on Jan. 15, 2002.

(51) Int. Cl.
*A63B 69/00* (2006.01)

(52) U.S. Cl. ..... 473/421; 473/451; 124/56; 124/71

(58) Field of Classification Search ..... 473/422, 473/421, 431, 451, 439, 454–456; 124/78, 124/79, 81, 45, 56, 58, 60, 63, 64, 71, 75
See application file for complete search history.

(56) References Cited

U.S. PATENT DOCUMENTS 3,930,486 A * 1/1976 Kahelin ..... 124/72
3,948,512 A * 4/1976 Worthington ..... 473/459
4,074,905 A * 2/1978 High ..... 473/421
4,094,294 A * 6/1978 Speer ..... 124/56
4,256,304 A * 3/1981 Smith et al. ..... 473/451
4,442,823 A * 4/1984 Floyd et al. ..... 124/78
4,774,928 A * 10/1988 Kholin ..... 124/75
4,886,269 A * 12/1989 Marocco ..... 473/431
4,915,384 A * 4/1990 Bear ..... 473/451
5,133,330 A * 7/1992 Sharp ..... 124/56
5,464,208 A * 11/1995 Pierce ..... 473/451
5,507,271 A * 4/1996 Actor ..... 124/56
5,549,302 A * 8/1996 Lapsker et al. ..... 473/416
5,566,934 A * 10/1996 Black et al. ..... 473/431
5,658,211 A * 8/1997 Glover ..... 473/422
5,746,670 A * 5/1998 Brady ..... 473/451
5,771,621 A * 6/1998 Rogers ..... 42/55
5,897,445 A * 4/1999 Sanders ..... 473/421
5,906,553 A * 5/1999 Carroccio ..... 473/421
6,202,636 B1 * 3/2001 O'Brien ..... 124/71
6,612,942 B1 * 9/2003 Battersby et al. ..... 473/451

* cited by examiner

*Primary Examiner*—Mitra Aryanpour
(74) *Attorney, Agent, or Firm*—McCormick, Paulding & Huber LLP

(57) ABSTRACT

A batting system wherein the ball hopper is located proximate a batting position and a pitching machine is located at a pitching position with a ball transport system for conveying baseballs from the ball hopper to the pitching machine. The system provides for the continuous operation of the pitching machine without the need of an operator to approach the pitching machine. In addition, the batting system allows multiple batting systems to use continuously the same field as well as use a field also used as part of a golf driving range.

4 Claims, 9 Drawing Sheets

BATTING SYSTEM

CROSS-REFERENCE TO RELATED APPLICATIONS

The present application is related to and claims priority of the following co-pending applications, namely, PCT application number PCT/US03/00983 of Hollrock Engineering, Inc. entitled "Open Loop Batting System" filed on Jan. 14, 2003. and U.S. Provisional Application No. 60/350,299 for "Batting System" filed on Jan. 15, 2002. Each of the above-identified applications are incorporated herein by reference in their entirety.

FIELD OF THE INVENTION

The invention generally relates to recreational sporting equipment and more specifically to a batting system for practicing hitting a baseball.

BACKGROUND OF THE INVENTION

In prior art batting systems, a pitching machine pitches a baseball toward a batter who is supposed to hit the pitched baseball with his/her bat. The batter stands within an enclosure, or cage, and the baseball is pitched toward the batter by the pitching machine. Generally when the batter strikes the baseball, he/she has little feedback on the baseball trajectory because the baseball trajectory is restrained by the enclosure. The trajectory of the baseball is interrupted so that the batter cannot see where the baseball would normally hit the ground. As a result, the batter never realizes how far the baseball may have gone, or knows the ultimate trajectory resulting from his/her swing the batter may have used on the pitch. In the event the batter misses the baseball, the baseball hits netting located behind the batter. Generally, the baseball, whether hit or missed, is automatically collected. The majority of collection systems rely on gravity to roll the baseball to a central collection point. Collection systems are generally required to avoid having the baseballs collect at the feet of the batter. In some cases, a baseball once collected may be transported back to a hopper on the pitching machine, thereby permitting the baseball to be pitched again.

In other batting systems, the pitching machine might be located in an open field into which a baseball may be hit, providing baseballs to the machine can then pose a problem. Pitching machines are of one of two types. In the first type, an operator individually places the baseballs in the pitching machine. In the second type, baseballs are placed in a hopper on the pitching machine.

Based on the foregoing, it is an object of the present invention to overcome the problems and drawbacks associated with the prior art.

SUMMARY OF THE INVENTION

The invention in one aspect is a batting system having a baseball hopper, pitching machine, and a baseball transport arranged for operation with the baseball hopper located proximate a batting position, i.e., near to a batter. The pitching machine is located in a field at a normal pitching distance from the batting position. The baseball transport moves a baseball from the baseball hopper to the pitching machine so that the batter can strike the baseball and observe its trajectory as it travels into an open field. As a result of the positioning of the baseball hopper and the pitching machine, nobody needs enter the field to put baseballs in the baseball hopper.

Generally, the batter is standing in a cage having an open side toward the field. The pitching machine is positioned to pitch a baseball through the open side of the cage to the awaiting batter. A baseball properly struck by the batter will exit the cage through the open side and land in the field. If the baseball is not properly struck, e.g., a foul or not struck, the baseball will hit netting that makes up the cage. For the baseballs that remain in the cage, a baseball collection system accumulates the baseballs for reuse by a subsequent batter.

A multiple batting system arrangement may be utilized in conjunction with a common field. Each batter may be in an individual cage. In such a multiple batting system arrangement, individual baseball hoppers may be provided as well as individual collection systems for accumulating the baseballs missed and/or fouled off by the batter.

The batting system may also be used in conjunction with a golf driving range. The batting systems and the golf driving range may be oriented such that properly struck baseballs and golf balls would fall within a common field.

DETAILED DESCRIPTION AND PREFERRED EMBODIMENTS

Figure 1:
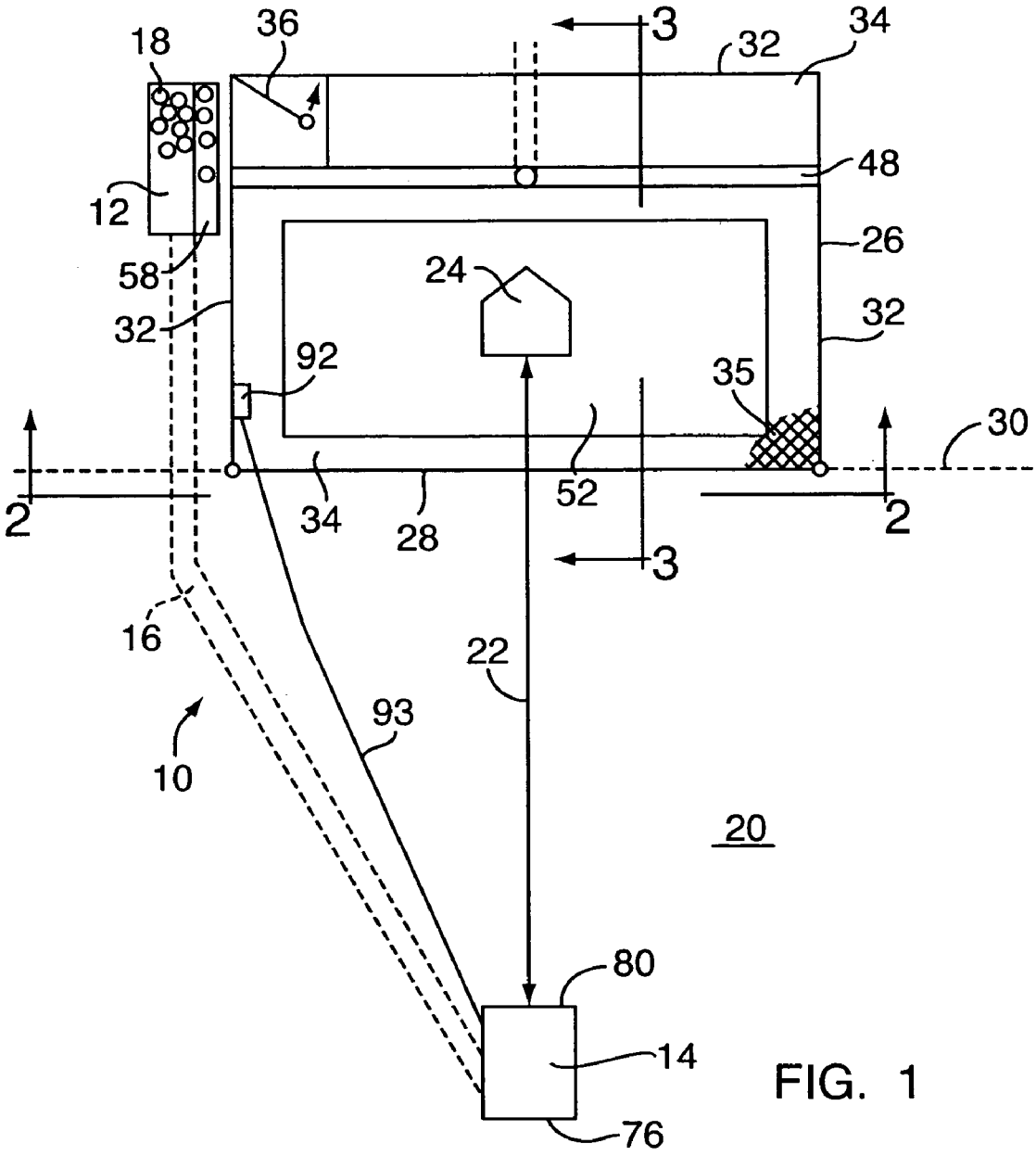
FIG. 1 shows a top view of a general layout of a single batting system.
Figure 2:
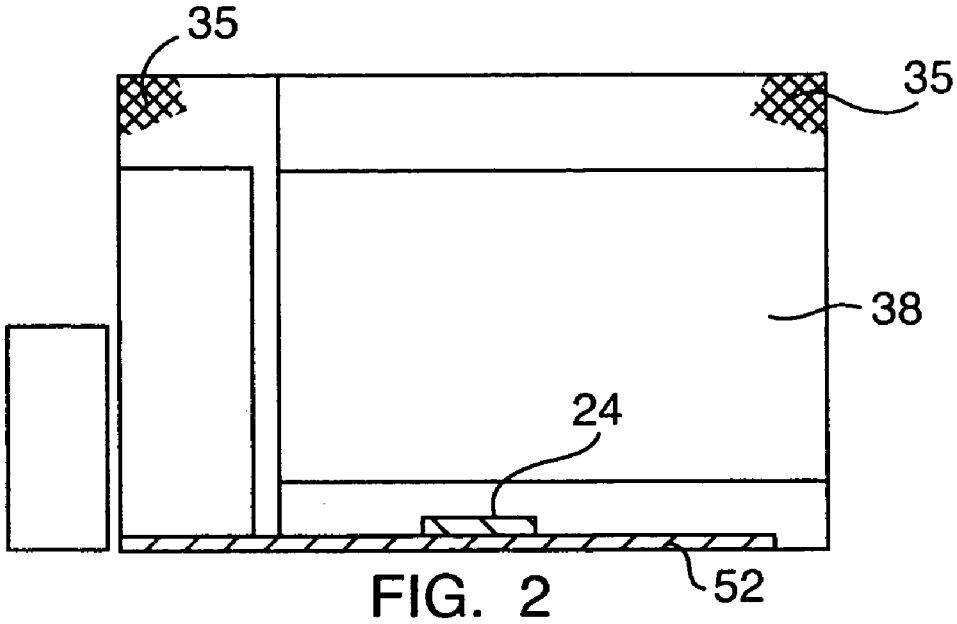
FIG. 2 shows a front view of the cage of FIG. 1 taken along line 2—2.
Figure 3:
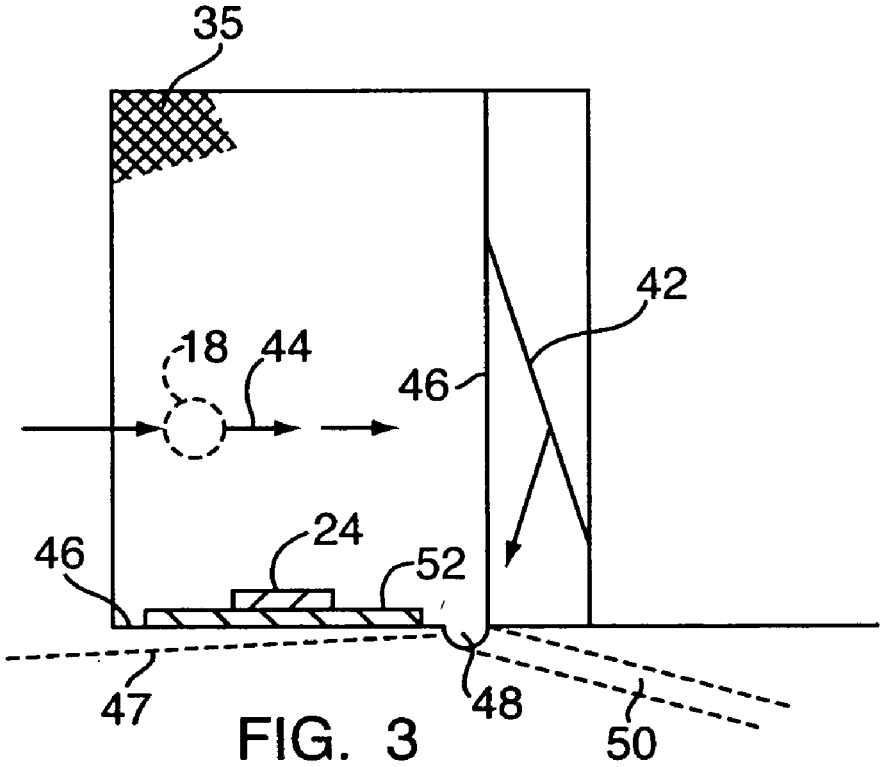
FIG. 3 shows a side view of the cage of FIG. 1 taken along line 3—3.

As shown in FIGS. 1–3, the batting system, generally denoted by the reference number 10 includes a baseball hopper 12, a pitching machine 14, and a baseball transport 16. The baseball transport 16 conducts baseballs 18 from the baseball hopper 12 to the pitching machine 14. When installed, the pitching machine 14 is positioned at a pitching position in a field 20 at a pitching distance 22 from a batting position designated by a plate 24. The pitching distance 22 is determined by the application based on such factors as the characteristics of the pitching machine 14, and the time needed by a batter (not shown) standing at the plate 24 to acquire visually and to react physically to a baseball 18 pitched by the pitching machine 14.

As stated above, the pitching machine 14 is positioned in the field 20. The field 20 is an area into which a baseball 18 properly struck by a bat (not shown) swung by the batter (not shown) will land. The plate 24 is located within a cage 26 having an opening 28 located such that a baseball 18 being pitched from the pitching machine 14 toward the plate will pass through the opening 28. If the batter properly strikes the baseball 18 with the bat, the baseball will exit the cage 26 through the opening 28 landing in the field 20. Thus in this case, the field 20 begins at the opening 28 (depicted by a dotted line 30) of the cage 26. The placement of the cage 26 and the opening 28 relative to the plate 24 are based on safety considerations, such as the trajectory of baseballs not properly struck by the bat of the batter. The baseball hopper 12 is positioned outside the field 20. The baseball hopper 12 can be placed in almost any location. In certain applications, the baseball hopper 12 is placed proximate the plate 24, where the batter will be located. While the baseball hopper 12 is shown placed outside the cage 26, this is not a requirement of the invention as it could be placed within the cage, if desired. While the baseball hopper 12 has been shown outside the field 20, it could be positioned in the field, if desired, as long as the batter (or other person) does not have to step upon the field to put baseballs 18 in the baseball hopper 12.

The cage 26 has sides 32, and a top 34 made from an openwork structure 35, such as netting made from knotted nylon. A door 36, which also may be made from an openwork structure 35, provides access into the cage 26 through a side 32, such that a batter does not have to step upon the field 20 to enter the cage through the opening 28.

Behind the plate 24 is a baseball catcher 38 having an opening 40. The baseball catcher opening 40 is positioned to allow a baseball 18 that is pitched but not struck by the bat of the batter to enter the baseball catcher 38. Preferably, the opening 40 is also large enough to permit some improperly struck baseballs 18, more commonly referred to as foul tips, to enter the baseball catcher 38. The baseball catcher 38 has a back wall 42 (the wall struck by an unstruck-pitched baseball) at an angle other than perpendicular to a direction of travel 44 of a pitched baseball 18, such that the baseball is deflected toward the ground 46. Preferably, the back wall 42 is structured such that it deflects when hit by a baseball 18 to absorb some of the momentum of the baseball. Suitable materials for the back wall 42 include vinyl. Typically, baseballs 18 will collect at the bottom of the baseball catcher 38.

The ground 46 within the cage 26, however, may be contoured to the horizontal 47 to permit baseballs 18 that land within the cage to roll, due to gravity, to a trough 48. A drain 50, which also employs gravity, may also be provided to permit the baseballs 18 to be directed outside the cage 26 to a collection center (not shown). Placed between the plate 24 and the ground 46 is a mat 52. The mat 52 defines an area in which a batter stands. The mat is preferably sized to accommodate both left- and right-hand batters.

Figure 4:
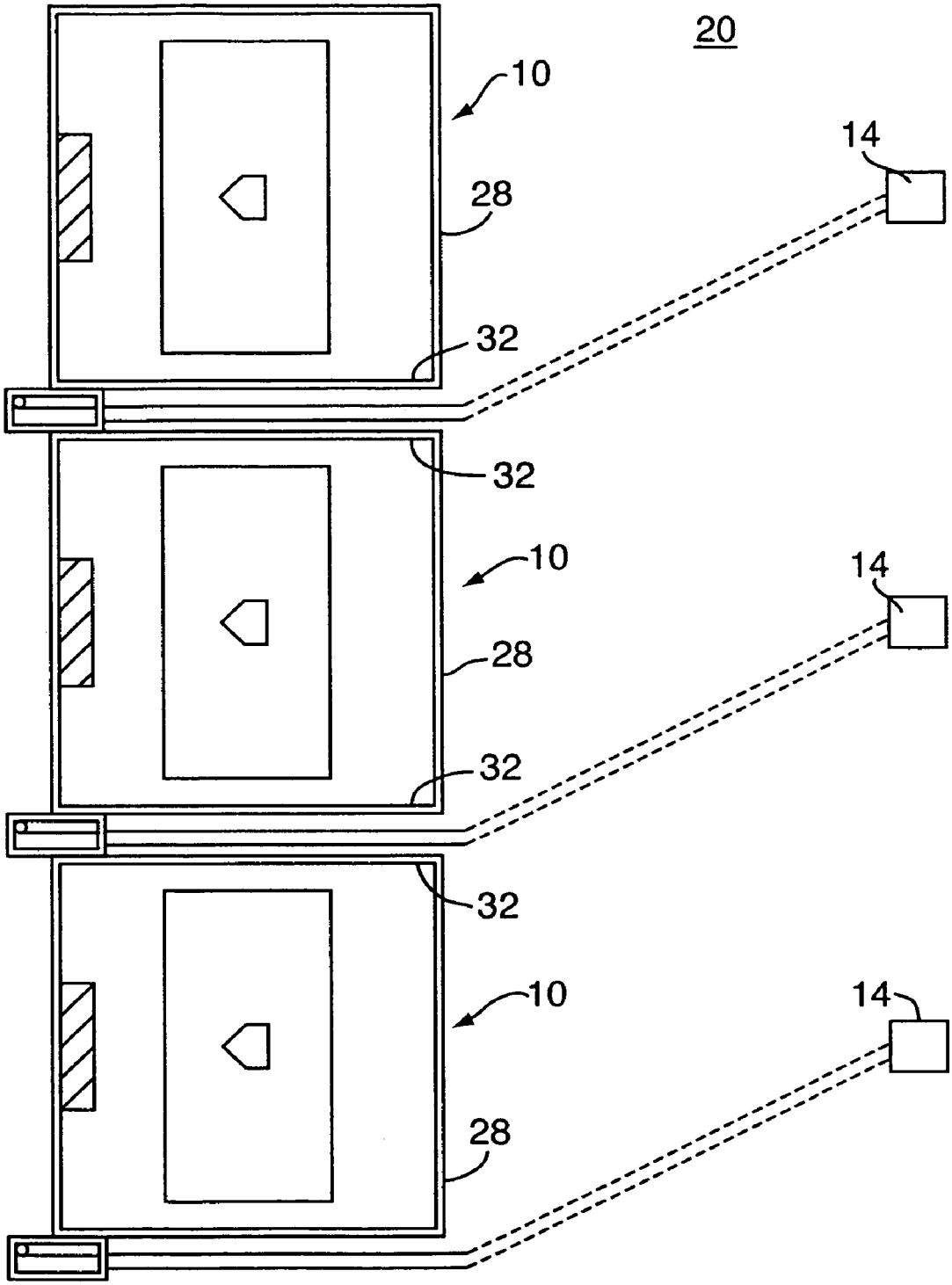
FIG. 4 shows a top view of multiple batting systems using a common field.

As shown in FIG. 4, multiple batting systems 10 can be placed one beside the other. While three batting systems 10 are depicted, the ultimate number is application dependent. Where batting systems 10 are placed beside each other, duplication of adjacent sides 32 may not be required. When units are placed side by side, preferably each opening 28 is oriented toward a common field 20. In this arrangement, all the pitching machines 14 are also located in the same common field 20.

Figure 5:
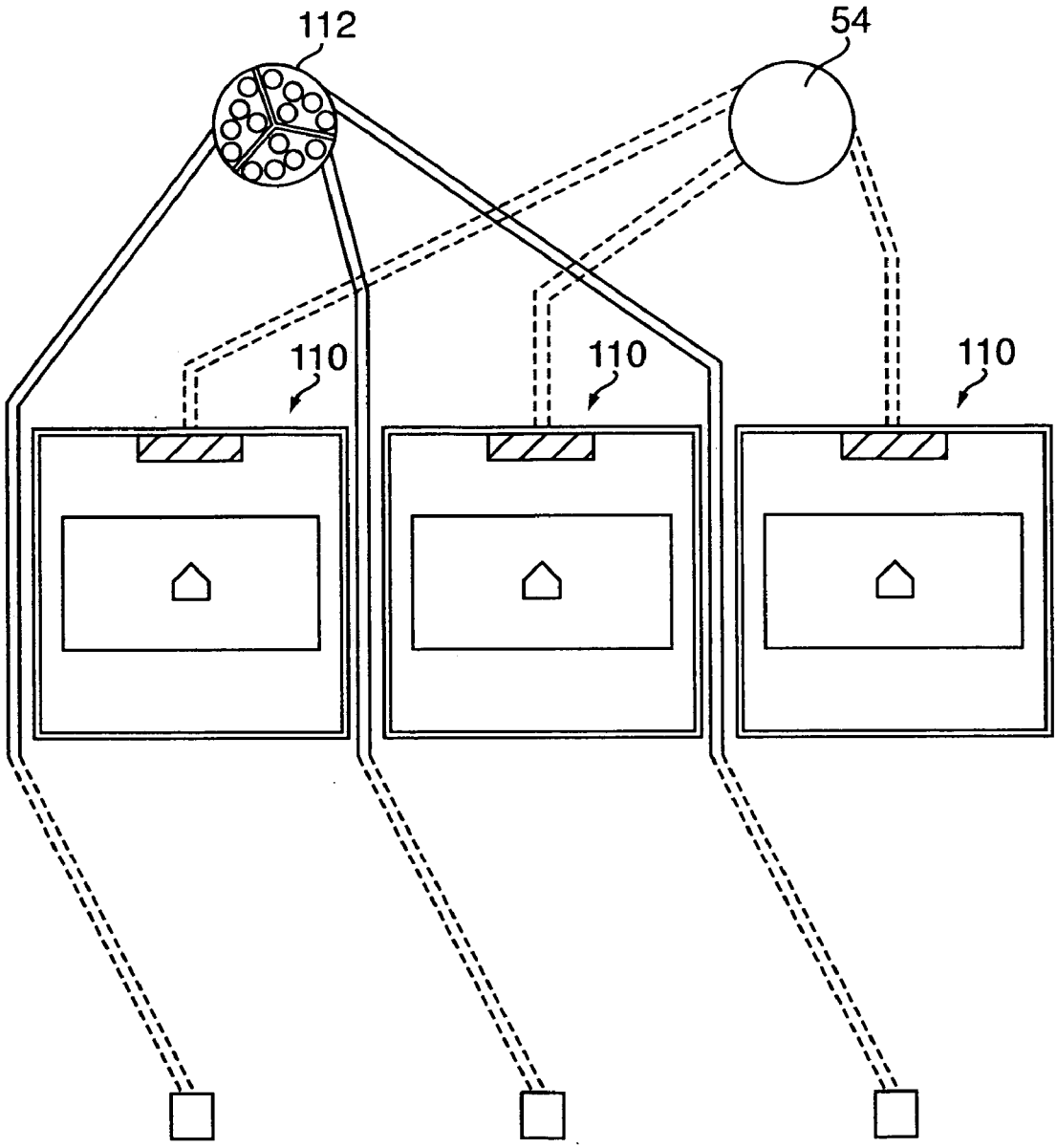
FIG. 5 shows a top view of another embodiment of multiple batting systems using a common field.

FIG. 5 depicts another multiple batting system 110 embodiment. As this embodiment has many features that are similar to features in the previously discussed embodiment, similar elements will be given the same reference number preceded by the number 1. In this embodiment, the baseball hoppers 112 for the several batting systems 110 are commonly located, as is a collection point 54.

Figure 6:
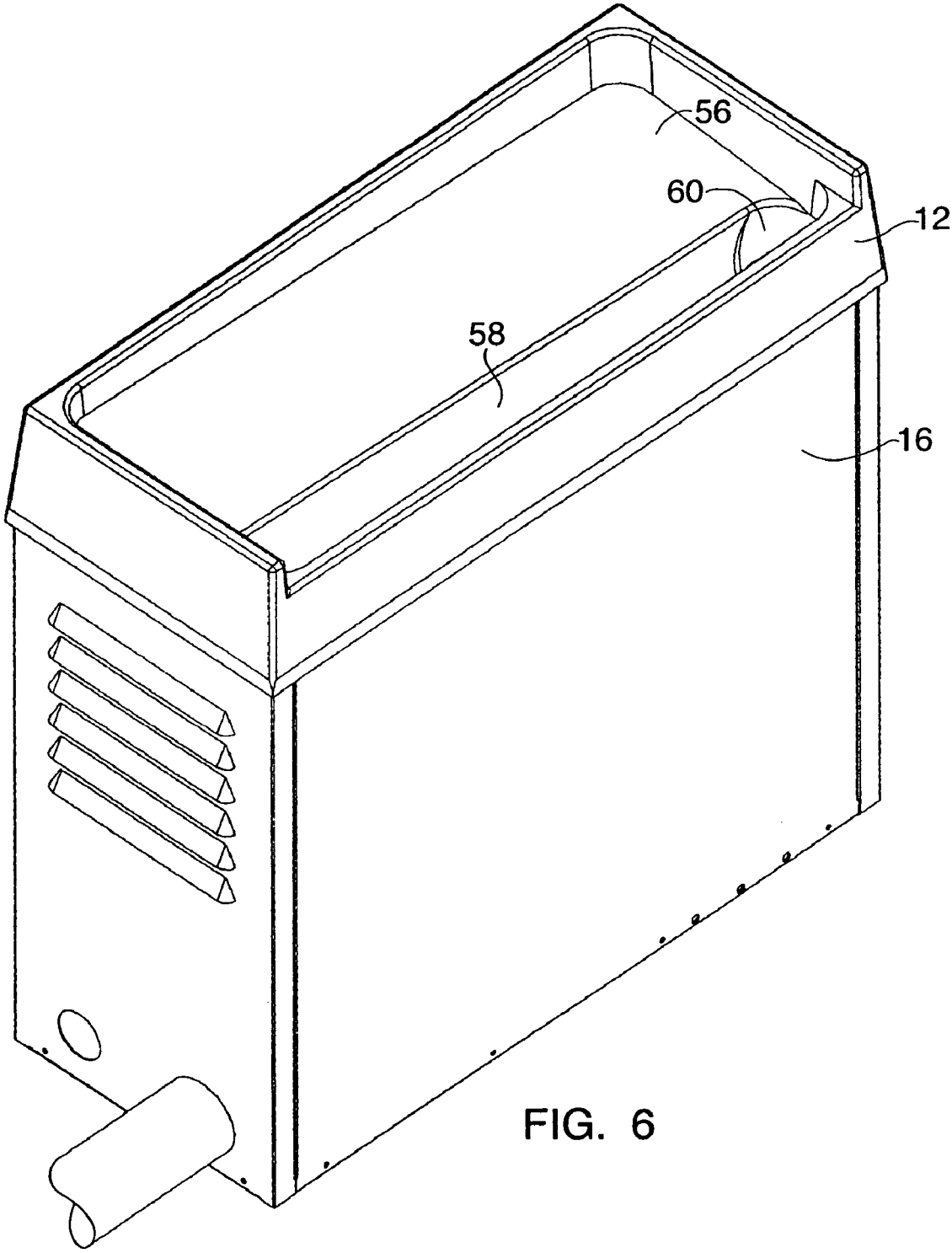
FIG. 6 shows a perspective top view of a baseball hopper atop a baseball transport.

Depicted in FIG. 6, is a baseball hopper 12 mounted atop the baseball transport 16. The baseball hopper 12 has a bottom 56 that is angled (when installed) such that baseballs 18 positioned in the baseball hopper roll by gravity into a channel 58. (See FIG. 1) The channel 58 has a cross-section and length such that a plurality of baseballs 18 aligns seriatim in the channel. The channel 58 also has a pitch, when installed, such that baseballs 18 in the channel roll toward a bore 60 that is sized to permit the baseballs 18 to exit seriatim the baseball hopper 12 into the baseball transport 16.

Figure 7:
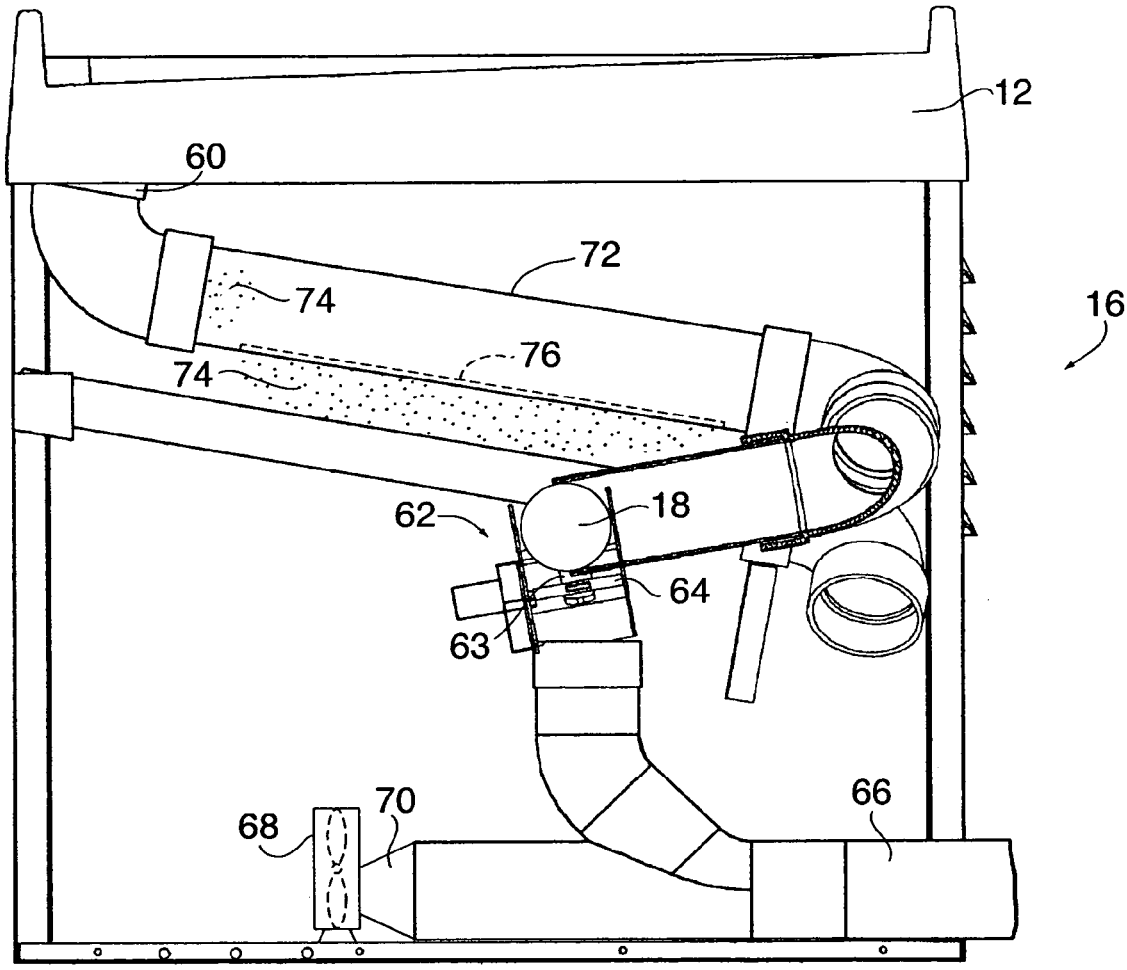
FIG. 7 shows a side view of one type of baseball transport.

Referring to FIG. 7, the baseball transport 16 has a ball escapement 62 that dispenses one baseball 18 at a time. The ball escapement 62 employs a pivoted gate 63 that rotates about an axis 64. Depending upon the location of the baseball transport 16 relative to the batter, noise created by the movement of the pivoted gate 63 may provide an audible signal to the batter that a baseball 18 is about to be pitched. The baseball transport 16 also includes a conduit 66 that terminates at the pitching machine 14 (See FIG. 1). The baseball 18 is transported through the conduit 66 by a ball conveyor 68, such as a pneumatic system utilizing a fan. The conveyor 68 has a discharge 70 coupled to the conduit 66. While a pneumatic system has been shown, other alternates for the conveyor 66, such as belts, are considered within the scope of the invention.

Continuing with FIG. 7, the bore 60 of the baseball hopper 12 is connected to the ball escapement 62 by a conduit 72. In operation, debris and/or water, collectively 74, may enter the conduit 72 through the bore 60. The conduit 72 has a slot 76 positioned over a trough 78 such that the debris and water 74 falls due to gravity through the slot into the trough. The trough 78 has an incline (when installed) such that debris and water 74 exits the trough due to gravity through an end of the trough.

Figure 8:
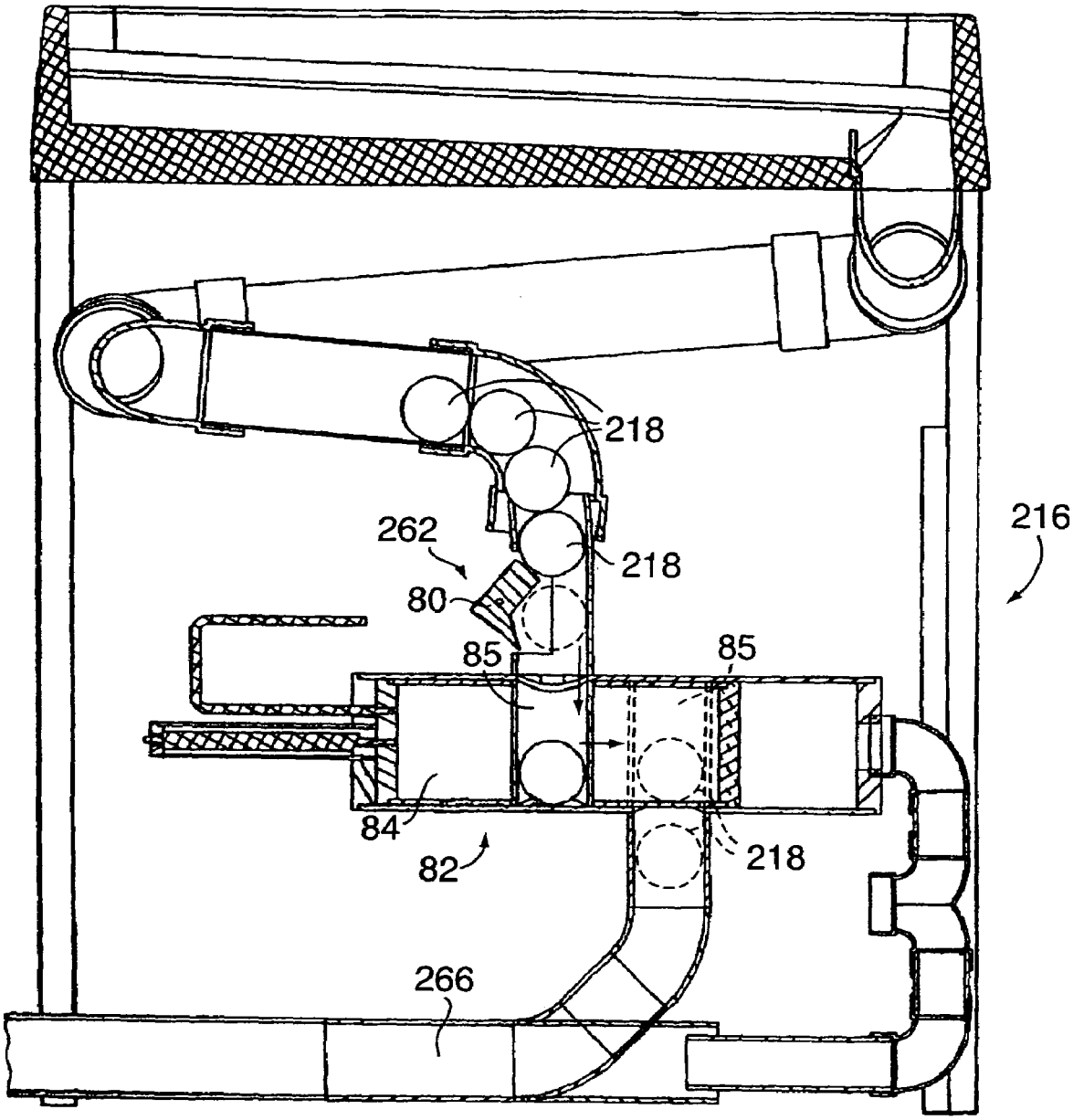
FIG. 8 shows a side view of another type of baseball transport.

FIG. 8 depicts an alternate embodiment of a baseball transport 216. As many of the features of this embodiment are similar to the embodiment discussed above similar numbers preceded by the number 2 will be used for similar elements. In this embodiment, the ball escapement 262 employs a pawl 80. By the action of the pawl 80, a baseball 218 is released while simultaneously baseballs 218 in the queue to be released are held. As with the previous embodiment, the action of the pawl 66 may function as an audible signal indicating the imminent pitching of a baseball 218.

A baseball 218 is released by the pawl 80 into an airlock 82. The airlock 82 includes a piston 84 with a through bore 85. The piston 84 in a first location positions the bore 85 to receive the released baseball 218. After the baseball 218 is within the bore 85, the piston 84 repositions the bore over the conduit 266, into which the baseball 218 drops due to gravity. The conduit 266 into which the baseball 218 drops connects to the pitching machine 14. The action of the airlock 82 may also function as an audible signal indicating the imminent pitching of a baseball 218.

Figure 9:
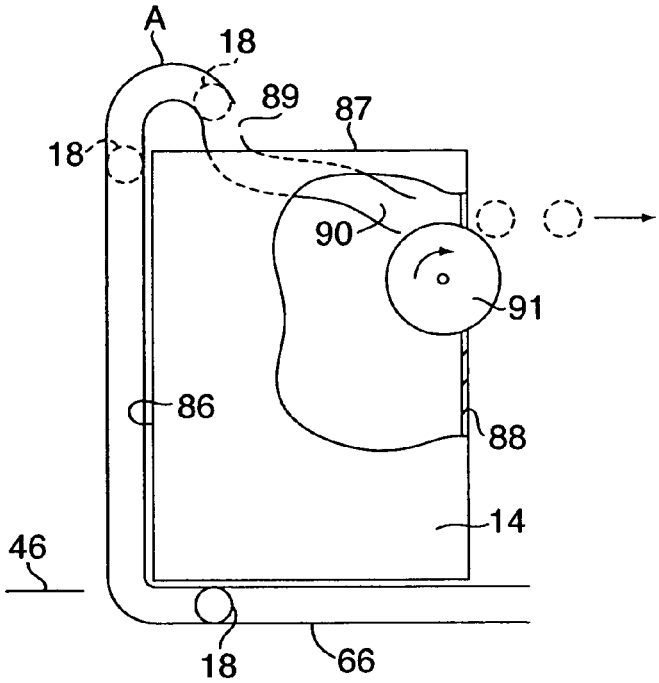
FIG. 9 shows a side view of a pitching machine.

As shown in FIG. 9, the pitching machine 14 has a back 86, a top 87, and a front 88. As shown in FIG. 1, the back 86 is oriented away from the plate 24 and the front 88 is oriented toward the plate. Continuing with FIG. 9, the conduit 66 defines an arch A from the back 86 into the top 87 of the pitching machine 14. In a portion of the arch A visible to a batter, the conduit 66 has a port 89, created by removing a portion from the conduit 66, to permit the batter to view the baseball 18 immediately prior to the baseball entering the pitching machine 14. The port 89 could also be created by a transparent or translucent section of conduit 66. In applications where any portion, or all of, the conduit 66 lays on the ground, the conduit may be entirely transparent or translucent to permit the batter to view the baseball 18 as it travels away from the cage 26 toward the pitching machine 14.

The conduit 66 places a baseball 18 into a baseball feed chute 90 of the pitching machine 14 that directs the baseball into contact with a wheel 91. The wheel 91, which is rotating in the direction indicated by the arrow, "pitches" the baseball 18 toward the plate 24. (See FIG. 1). Referring to FIG. 1, the pitching machine 14 has a controller 92 located out of the field 20, preferably proximate the batting position indicated by the plate 24. The controller 92, which is connected to the pitching machine 14 by a cable 93, has knobs and switches for regulating the speed of the pitch (preferably between about 15 and 60 miles/hours), and turning the pitching machine on or off. Alternatively, the controller 92 could be positioned at or on the pitching machine 14, or at a location out of the field 20 remote from the batter. A suitable pitching machine is a JUGS Jr. from The Jugs Company of Tualatin, Oreg.

Figure 10:
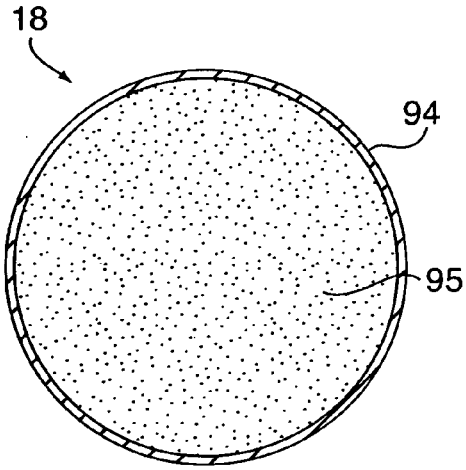
FIG. 10 shows a cross-sectional view of a baseball for use with the present invention.
Figure 11:
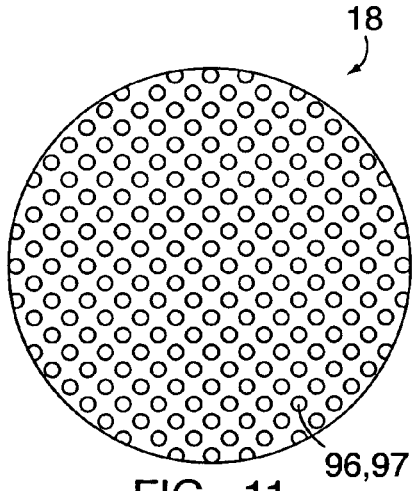
FIG. 11 shows a side view of a baseball for use with the present invention.
Figure 12:
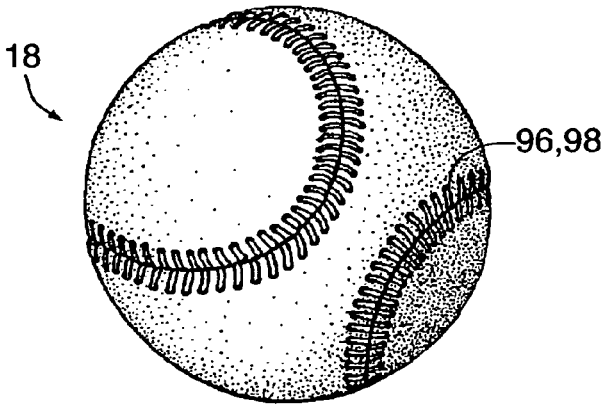
FIG. 12 shows a side view of another baseball for use with the present invention.

Continuing with FIG. 10, the baseball 18 is sized to be compatible with the selected pitching machine 14. The baseball 18 is made from an open cell flexible foam using an integral skin forming process. The baseball 18 is molded in accordance with Process Specification No. Hollrock 435738115 by S.S.F. Molders of Two Rivers, Wis. The baseball 18 has a cover 94 that is harder than the core 95. For safety, the baseball 18 is softer than a regulation hardball. The baseball 18 has a diameter of approximately 2 ¾ inches and a weight of approximately 3 ounces. In addition, the cover 94 may have a color selected to contrast with the environment in which it is used to assure better visibility of the baseball 18 to a batter. While any number of colors may be selected, brilliant, strong and vivid colors are preferred (See ISCC-NBS Method of Designating Colors). Colors containing red, orange or yellow are preferred. As shown in FIGS. 11 and 12, the cover 94 may also have impressions 96 therein, such as dimples 97 or laces 98. Impressions 96 may be designed to assist in the flight of the baseball 18 both during pitching and after being struck.

Figure 13:
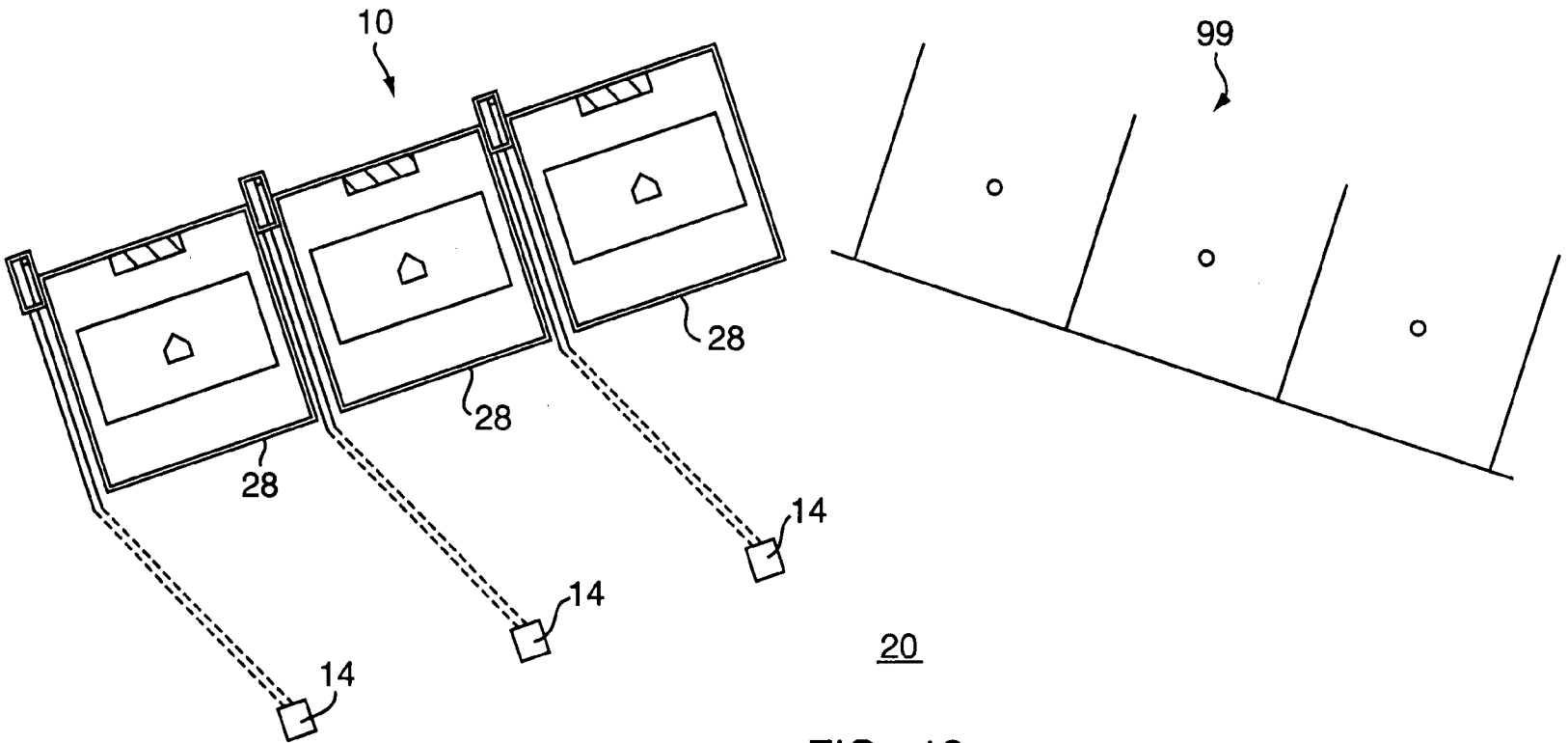
FIG. 13 shows a top view of a golf/batting range.

FIG. 13 depicts a golf/batting range employing the present invention. The golf/batting range has at least one batting system 10 and at least one golf station 99. The at least one batting system 10 is oriented as is the at least one golf station 99 such that a properly struck ball, be it baseball or golf ball, will land in the common field 20.

While the present invention has been described in considerable detail with reference to certain preferred versions thereof, other versions are possible. For example, two versions of a ball escapement have been shown but other ball escapements based on other sequential separators are considered within the scope of the invention. Therefore, the spirit and scope of the invention should not be limited to the description of the preferred versions contained herein.

What is claimed is:

1. A baseball handling system for batters comprising: a batting station having a hopper into which an allocated number of baseballs can be provided, a pitching machine spaced forwardly of the batting station, an open cage facing the pitching machine and in back of the batting station so that balls delivered from the pitching machine to the batting station can be collected adjacent to the batting station, and a baseball transport system having an inlet end adjacent said hopper at said batting station and an outlet end for delivering baseballs to the pitching machine said transport system including a ball escapement mechanism at said batting station for releasing balls seriatim from said hopper for transport to said pitching machine.

2. The baseball handling system according to claim 1 wherein said baseball transport system includes a pneumatic baseball delivery tube for carrying baseballs from said escapement mechanism at the batting station to the pitching machine.

3. The baseball handling system according to claim 1 wherein said open cage is so designed as to allow for uninterrupted flight of a struck baseball by the batter at said batting station into an open area in front of the batting station including areas of equal size to the left and the right sides of the pitching machine when viewed from the batting station.

4. The baseball handling system according to claim 1 further including a controller located at the batting station adjacent to the hopper for the convenience of the batter in timing the transport of a baseball from the ball escapement mechanism to said pitching machine for delivery to the batting station.

* * * * *